United States Patent [19]

Tresselt

[11] 4,414,550

[45] Nov. 8, 1983

[54] LOW PROFILE CIRCULAR ARRAY ANTENNA AND MICROSTRIP ELEMENTS THEREFOR

[75] Inventor: Carl P. Tresselt, Towson, Md.

[73] Assignee: The Bendix Corporation, Southfield, Mich.

[21] Appl. No.: 289,851

[22] Filed: Aug. 4, 1981

[51] Int. Cl.[3] ..... H01Q 3/30; H01Q 9/28

[52] U.S. Cl. ..... 343/700 MS; 343/373

[58] Field of Search ..... 343/700 MS, 853, 854, 343/100 SA

[56] References Cited

U.S. PATENT DOCUMENTS

| | | | |
|---|---|---|---|
| 3,887,925 | 6/1975 | Ranchelli et al. | 343/814 |
| 4,128,830 | 12/1978 | McComas | 343/112 CA |
| 4,291,312 | 9/1981 | Kaloi | 343/700 MS |
| 4,318,107 | 3/1982 | Pierrot et al. | 343/700 MS |

OTHER PUBLICATIONS

Page 11-66 of the Radar Handbook, edited by M. I. Skolnik-McGraw-Hill, 1970.

*Primary Examiner*—Eli Lieberman

*Attorney, Agent, or Firm*—W. G. Christoforo; Bruce L. Lamb

[57] ABSTRACT

An antenna element is comprised of two rectangular microstrip patch dipoles spaced by dielectric a predetermined distance above a ground plane conductor. One edge of each dipole is electrically shunted to the ground plane conductor. The dipole feedpoints are separated by a quarter wavelength of the antenna resonant frequency. An isolated power splitter and phase shifter connects an antenna element port with the dipole feedpoints so that the signal at one feedpoint lags the signal at the other feedpoint by 90°. The antenna element will end fire through the dipoles in the direction of the lagging signal feedpoint.

A low profile circular array antenna is comprised of eight such antenna elements arranged on the ground plane conductor equally spaced with their phase centers on a common phase center circle.

12 Claims, 9 Drawing Figures

FIG. 1
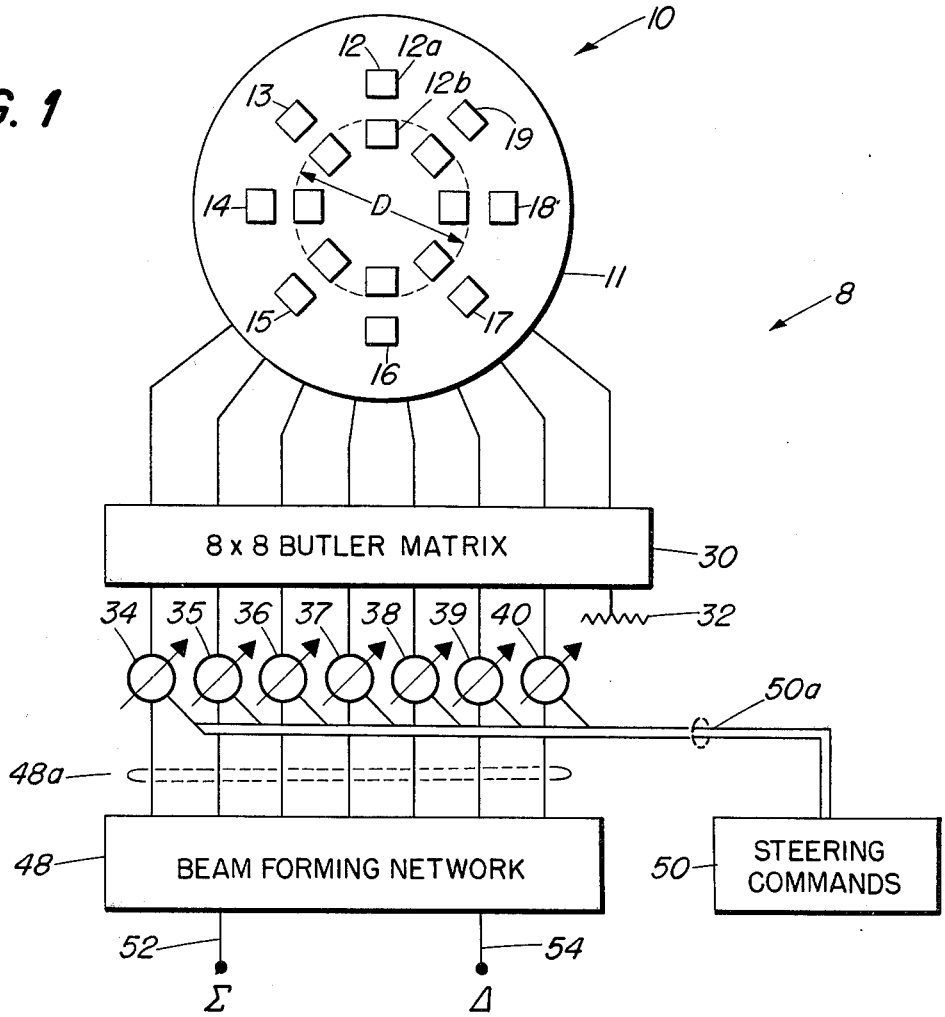
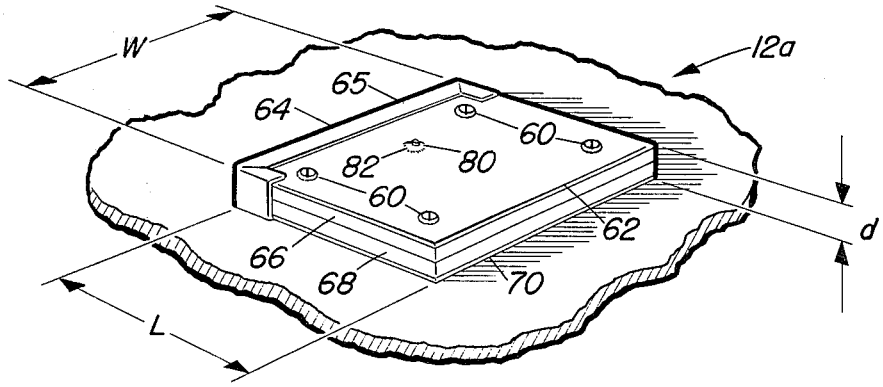
FIG. 2

FIG. 3
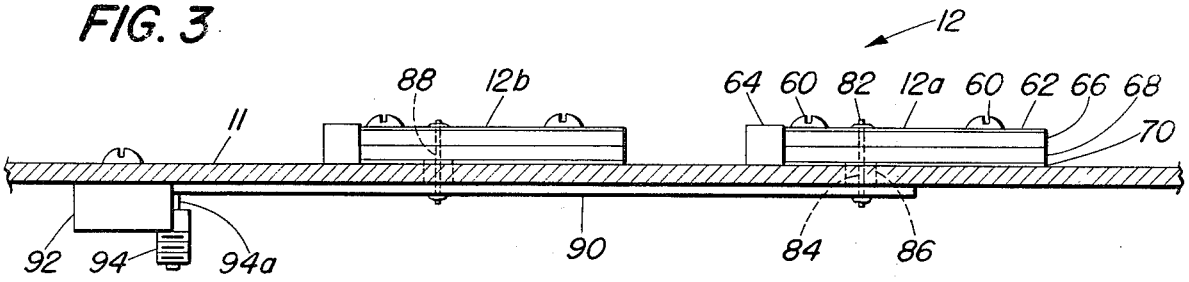
FIG. 4
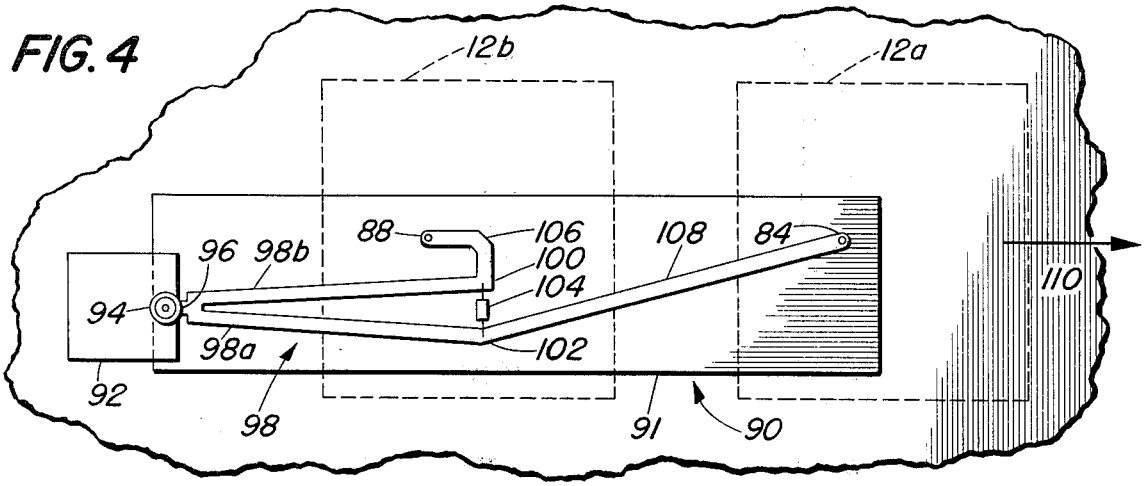
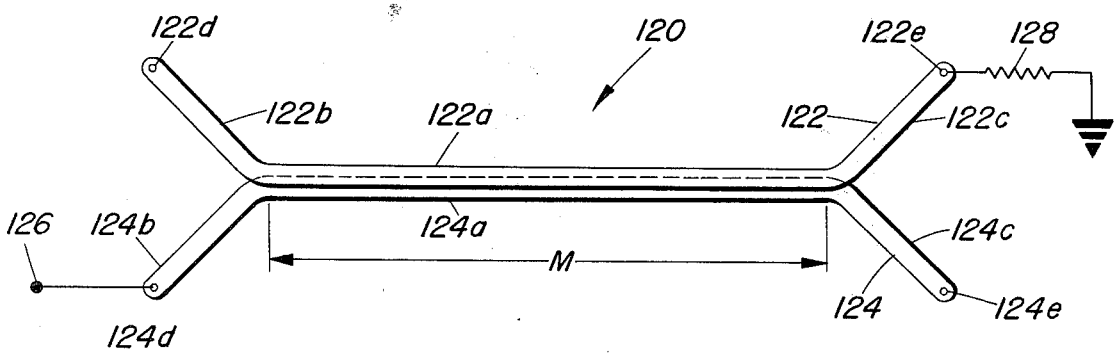
FIG. 5

LOW PROFILE CIRCULAR ARRAY ANTENNA AND MICROSTRIP ELEMENTS THEREFOR

This invention relates to antenna elements comprised of patch dipoles and electronically steerable arrays of such elements and more particularly to such patch dipoles which are individually comprised of a flat microstrip radiating plate disposed in spaced relationship to a reflector or ground plane conductor and antenna elements comprised of two such patch dipoles and arrays of such antenna elements arranged with respect to a common ground plane conductor and fed through phase shifting power splitters to produce end firing of said antenna elements and array.

It is generally known by those practicing antenna design that a flat microstrip or patch dipole antenna arranged parallel to and in close spaced relationship with a ground plane conductor will exhibit a broadside antenna pattern, that is, a generally hemispherical antenna pattern on the dipole side of the ground plane with the ground plane forming the flat side of the hemisphere. If, however, two such patch dipoles, for example, are each arranged in the same close space relationship with and parallel to a ground plane conductor, separated from one another by a quarter wavelength of their operating frequency and have their feed points connected through a quarter wavelength phase delay, the two dipoles will form an end firing antenna element whose antenna pattern will be directed generally along a line connecting common points on the dipoles and in the direction of phase delay.

It has been proposed that a plurality of such antenna elements be arranged to form a low profile circular antenna array which can be used with standard beam forming and steering circuits to provide 360° steerable directional antenna coverage.

SUMMARY OF THE INVENTION

According to the present invention a plurality of antenna elements are arranged on a ground plane conductor so that the phase centers of the elements lie equally spaced on the antenna phase center circle. Each antenna element is comprised of two patch dipoles each of which consists of a rectangular microstrip radiating plate spaced a predetermined distance from the ground plane conductor and wherein one edge of the plate is electrically shunted to the ground plane conductor. The patch dipoles are arranged serially on a radial line from the common physical center of the antenna array with the dipole feedpoints separated by a predetermined distance, suitably equivalent to a quarter wavelength of the design frequency. An isolated power splitter for each antenna element is provided which splits the power at an antenna element port equally and coherently to second and third ports which are connected through phase shift means respectively to the feedpoints of the patch dipoles, the phase shift being such that the signal fed to one feedpoint is phase shifted an amount equivalent to the predetermined free space distance between feedpoints with respect to the signal at the other feedpoint. With this arrangement the antenna element will end fire in the direction of the lagging signal feedpoint.

More particularly, the edges of the patch dipoles shunted to the ground plane conductor are arranged on the above-mentioned radial line to be perpendicular to that line and directed toward the physical center of the antenna array.

The main object of the invention is to provide a circular array antenna having a low profile.

Another object of the invention is to provide an antenna element for a low profile array antenna comprised of two patch dipoles and using an isolated power splitter to feed the dipoles.

One further object of the invention is to provide a low profile circular array antenna using standard quarter wave patch dipoles.

These and other objects of the invention will be made clear below with a reading and understanding of the below described embodiment of the invention wherein the illustrative figures comprise:

FIG. 1 which is a schematic illustration of the antenna system array of this invention connected into an electronically steerable antenna;

FIG. 2 which illustrates a typical patch dipole;

FIG. 3 which shows a side view of a typical antenna element;

FIG. 4 which shows the underside of a typical antenna element and illustrates a power splitter and phase shifter in detail;

FIG. 5 which illustrates a different form of power splitter and phase shifter which can be used with the present invention;

FIG. 6 which illustrates an 8-element low profile circular array antenna;

FIG. 7 which details the physical dimensions of an antenna element operative at 1060 MHz; and FIGS. 8 and 9 which illustrate antenna patterns.

DESCRIPTION OF THE PREFERRED EMBODIMENT

Figure 6:
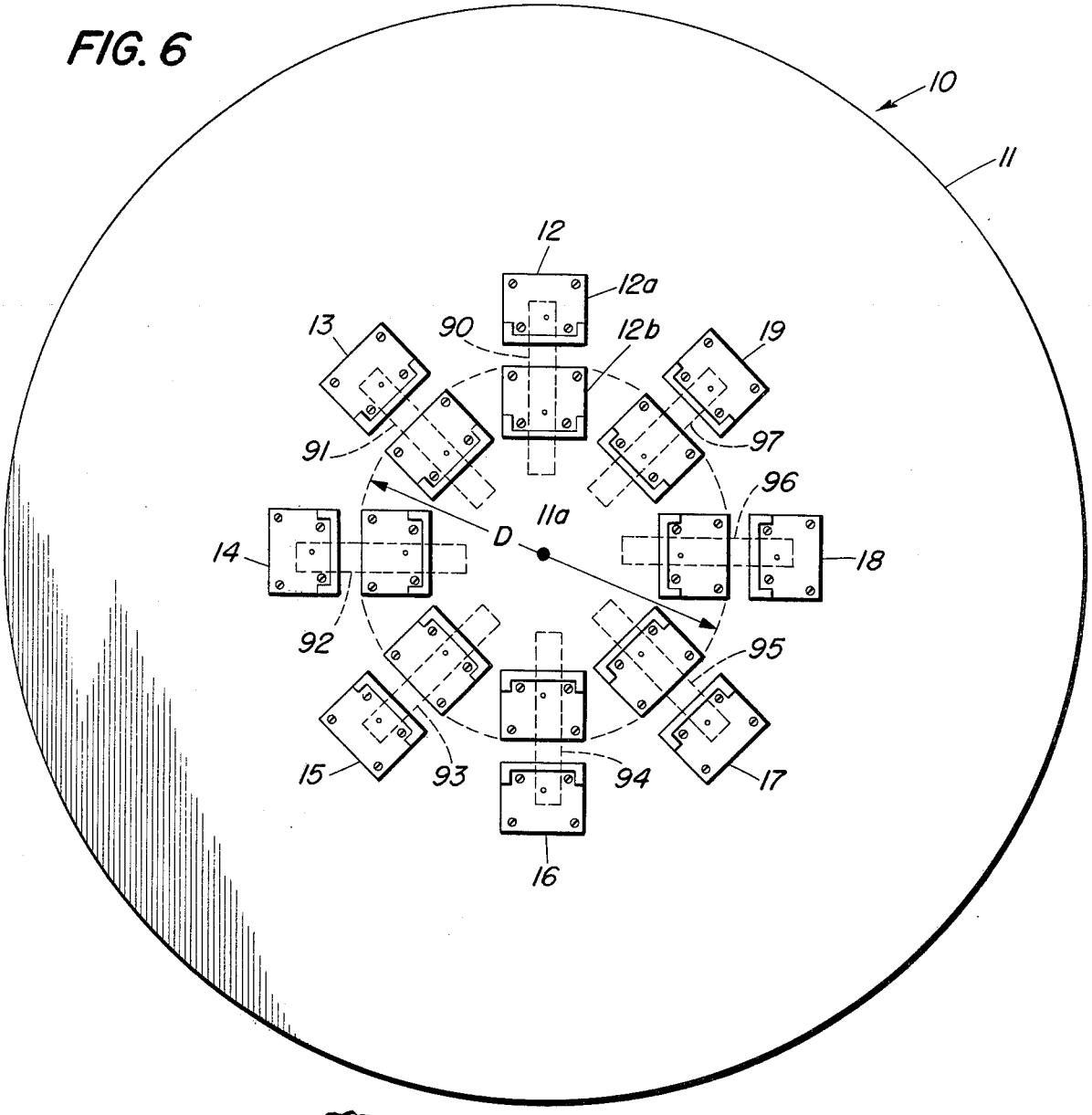

The preferred embodiment of the present invention is seen as antenna 10 at FIG. 1, reference to which figure should first be made. Antenna 10 is seen connected into a standard electronically steerable antenna system 8 comprised of, in addition to antenna 10, an 8×8 Butler matrix 30, phase shifters 34–40 which are controlled by a steering command module 50, and a beam forming network 48. Electronically steerable antenna system 8 is very similar to those shown in the prior art and particularly the electronically steerable antenna system shown and described in U.S. Pat. No. 4,128,833 to Arthur D. McComas and which is commonly assigned with the present invention. The obvious difference between the prior art and the present invention, of course, is the lower profile circular array antenna shown as antenna 10 which was not known in the prior art. For example, the above-mentioned McComas patent shows an antenna array comprised of 8 monopoles disposed around a cylinder rather than the flat antenna arrangement of the present invention. Briefly, antenna 10 consists of a reflection or ground plane conductor 11, which is here shown as round but could also be square or some other shape as known to those skilled in the art. Eight antenna elements 12–19 are disposed on the ground plane conductor so that their mean phase centers are equally spaced on a circle of diameter D. The significance of diameter D will be discussed in greater detail below. The antenna elements are individually connected into eight port Butler matrix 30 which, as known to those skilled in the art, is a signal transformer which in the present embodiment transforms multiple weighted input signals with a linear phase gradient to steered input signals for a circular array. Such a matrix is shown in detail at page 11-66 of the Radar Handbook, edited by M. I. Skolnik and published in 1970 by the McGraw-Hill Book Company.

The antenna beam or pattern is steered, in this embodiment, by a command signal received by phase shifters 34–40 via lines 50*a* from a steering command generator 50. The logic for generating steering commands does not comprise a part of this invention and thus need not be described. Briefly, steering commands might typically steer the antenna beam toward a fixed remote transponding station whose position is being tracked by means of signals received therefrom at directional antenna 10. Phase shifters 34–40 are typically conventional six-bit phase shifters, suitably of the diode phase shifter type. Such phase shifters will allow the antenna to be steered to a plurality of distinct positions. Other known steering techniques will permit the antenna to be effectively steered continuously through 360°.

Although an 8 port Butler matrix is used, only 7 variably phase shifted signals are applied thereto from the 7 phase shifters 34–40. An eighth Butler matrix port is terminated by characteristic impedance 32 to absorb any out of balance signals and an unused +3 high order circular mode as known to those skilled in the art.

A passive beam forming network 48 is connected to phase shifters 34–40. Network 48 is simply a tree of directional couplers, hybrids or like devices which receives power from ports such as 52 and 54 and distributes it to phase shifters 34–40 via lines 48*a*. More specifically, in the present embodiment the signals from beam forming network 48 on lines 48*a* are weighted to ultimately produce a sum beam from the array antenna if port 52 is energized and weighted to produce a difference beam if port 54 is energized. Butler matrix 30 transforms the weighted, phase shifted multiple output signals, similar in form to those for a linear array, into the desired signals for a circular array antenna. Of course, the device of FIG. 1 is also used for receiving radar signals incident on antenna 10, as known to those skilled in the art, in which case a sum signal will appear at port 52 and a difference signal at port 54.

Each antenna element is comprised of two patch dipoles, for example, antenna element 12 is comprised of patch dipoles 12*a* and 12*b*. A typical patch dipole is shown at FIG. 2, reference to which should now be made. In that figure typical patch dipole 12*a* is seen attached to ground plane conductor 11 by 4 electrically non-conductive screws 60. Basically, a dipole consists of a rectangular conductive plate, such as copper plate 62, parallel to and spaced a distance d above ground plane conductor 11 and which has one side electrically shorted or shunted to the ground plane conductor by means of copper foil 64 which is wrapped around side 65 between plate 62 and ground plane 11. In the practical embodiment here illustrated plate 62 is copper cladding on a standard teflon-fiberglass stripline board 66 which is spaced off the ground plane by an identical board 68 whose copper cladding plate 70 is in electrical contact with ground plane 11. Copper foil 64 is Scotch brand X-1181 copper foil tape soldered to both plate 62 and 70. More correctly, patch dipole 12*a* is what is known in the art as a short circuit half dipole. Dimension L is generally equivalent to one-quarter wavelength at the dipole operating frequency. In the present case, L is definitely shorter than one-quarter wavelength in air because of the dielectric loading effect of plates 66 and 68. It will be noted that the actual frequency of operation is affected by how much foil 64 covers the two sides of the patch, frequency rising as more of the L dimension is covered on each side. The length of foil can be trimmed easily, thus providing a means of tuning the element. The dimensions of a patch dipole actually used will be given below.

The distance d of plate 62 above ground plane conductor 11 principally determines the bandwidth of the dipole, as known to practitioners in the art, the bandwidth increasing as d increases. To a lesser degree, a larger width W will also increase bandwidth.

The dipole is fed by a copper wire which extends from beneath ground plane conductor 11 and through boards 66 and 68. One end 82 of the wire is seen soldered to plate 62 at 80. The length of the wire is not seen in this view but is seen in FIG. 3, reference to which should now be made. Here antenna element 12, comprised of patch dipoles 12*a* and 12*b*, is seen attached to ground plane conductor 11. With respect to patch dipole 12*a*, copper plates 62 and 70, dielectric plates 66 and 80, screws 60 and copper foil 64 are shown for orientation purposes. Copper wire 84 having end 82 soldered to plate 62 is seen extending through dipole 12*a* and ground plane conductor 11 to a microstrip power splitter and phase shifter 90. The lower copper plate 70 has a hole in it concentric with wire 84 to prevent shorting. A teflon bushing 86 is located concentrically around wire 84 as it passes through ground plane conductor 11, forming via the choice of dimensions a short length of 50 ohm coaxial line between patch 12*a* and splitter 90. The lower end of wire 84 is soldered to a copper microstrip track on the power splitter and phase shifter 80, which is described in more detail below. Of course, a similar wire 88 provides the signal feed for dipole 12*b*. Power splitter and phase shifter 90 receives input power from the Butler matrix via the center conductor 94*a* of coaxial connector 94 which is mounted on spacer 92 below the ground plane conductor. The outer conductor of coaxial connection is electrically shorted to ground plane conductor 11 through spacer 92.

Power splitter and phase shifter 90 is seen in better detail in FIG. 4, reference to which figure should now be made. Here power splitter and phase shifter 90 is seen to include an insulative printed circuit board 91 mounted to the underside of ground plane conductor 11 underlying the antenna element comprised of patch dipoles 12*a* and 12*b*. Board 91 carries a power splitter circuit 98, known as a Wilkenson divider, which uses quarter wavelength bifurcated legs 98*a* and 98*b* whose junction 96 is electrically connected to the center conductor of coaxial connector 94 which comprises the antenna element port. Legs 98*a* and 98*b*, each of which has a characteristic impedance of 70.7 ohms, are series terminated at their other ends 100 and 102 by a 100 ohm resistance 104. The power splitter is essentially a three port circuit having ports 96, 100 and 102 with a useable bandwidth of about one octave. The power division accuracy is not frequency sensitive and is, therefore, strictly a function of the accuracy of the device construction. Port 100 is connected through a short 50 ohm stripline segment to copper wire 88 which it will be remembered has its opposite end connected to feed patch dipole 12*b*. Port 102 is connected through a 50 ohm quarter wavelength segment of stripline 108 to copper wire 84, which it will also be remembered has its opposite end connected to feed patch dipole 12*a*.

The operation of power splitter circuit 98 and quarter wavelength segment 108 in conjunction with dipoles 12*a* and 12*b* is as follows. A signal is applied via coaxial connector 94 to port 96. The signal is split into two separate but equal and coherent signals on ports 100 and 102 respectively. The signal at port 100 is fed through stripline 106 and copper wire 88 to patch dipole 12*b*. The signal at port 102, although fed to patch dipole 12*a*, is delayed 90° in phase by quarter wavelength segment 108. Thus, the signal at patch dipole 12*a* lags the signal at patch dipole 12*b* by 90°. If patch dipole 12*a* is spaced a quarter wavelength from patch dipole 12*b* in air, the antenna element will end-fire in the direction of arrow 110 rather than firing broadside as would be the case if the dipoles were energized differently. To the first order, reflections from the VSWR of the two patches reach back to the power splitter ports 100 and 102 with 180° phase difference and so will be absorbed by resistor 104. It can thus be seen that dipole feed 84 is isolated from dipole feed 88.

A different type of power splitter and phase shifter suitable for use in the invention is shown in FIG. 5, reference to which should now be made. Here power splitter and phase shifter 120 is basically comprised of stripline track 124 which underlies a second stripline track 122 so as to couple thereto along the sections 122*a* and 124*a* thereof. Coupling is generally accomplished in the length M, which is equal to one-quarter wavelength in the medium of construction, which will be pointed out below. Track 124 includes offset sections 124*b* and 124*c*. Section 124*b* is adapted to be electrically connected to an antenna element port 126, which is equivalent to the center conductor 94*a* of coaxial connector 94 of FIG. 3. Section 124*c* is adapted at 124*e* to be electrically connected to the feedpoint of the front most patch dipole of an antenna element, such as patch dipole 12*a* of FIG. 3, through wire 84 of FIG. 3. Track 122 includes offset sections 122*b* and 122*c*, the first of which is adapted at 122*d* to be electrically connected to the feedpoint of the rearward patch dipole of an antenna element, such as patch dipole 12*b* of FIG. 3, through wire 88 of FIG. 3. Section 122*c* is adapted at 122*e* to be terminated by characteristic impedance 128.

The operation of power splitter and phase shifter 120 is as follows. A signal impressed at point 124*d* is coupled to track 122*a* along length M. The device is designed to have a −3dB coupling so that the signal is split equally to points 124*e* and 122*d*. There is, moreover a quarter wavelength phase shift delay of the signal at point 122*d* with respect to the signal at point 124*e* caused by the length M of the coupling section comprised of overlaid sections 122*a* and 124*a*. It is, of course, assumed that all offset sections 122*b*, 122*c*, 124*c* are of equal lengths. As in the Wilkenson divider described above, reflections from the VSWR of the two patch dipoles reach back to point 122*e* to be absorbed by impedance 128. Thus, it can be seen that the dipole feeds are essentially isolated from one another.

Coupler 120 can be constructed as a three layer symmetric strip transmission line. This type of construction is known to those in the art and need not be exhaustively described. Briefly, a coupler so constructed can be very well shielded and would consist of a sandwich of three stripline boards. The top and bottom boards of the sandwich preferably would have a ground plane conductor on the surfaces external to the sandwich. The center board would have track 122 on one side of the board and track 124 underlying it, and on the other side of the board, the tracks being coupled through the material of the board. A simple pill type impedance of the type commonly used in stripline construction is preferable as impedance 128. The sides of the sandwich are preferably covered with an RF shield material such as a foil grounded to the ground plane conductors on the external surfaces of the sandwich for complete RF shielding, except for signal access which is provided in the conventional manner. Referring now also to FIG. 4, coupler 120 is preferably mounted on the bottom of the antenna ground plane conductor 11, in place of the Wilkenson coupler shown, with points 124*e* and 122*d* respectively directly underlying the patch dipole feed points so that wires 84 and 88 are respectively electrically connected directly to points 124*e* and 122*d*. In this regard it should be noted that the straight line distance between points 122*d* to 124*e* is equal to the distance between the feed points of the two patch dipoles (See FIG. 6) which is a quarter wavelength. The actual physical distance between points 122*d* and 123*e* will generally differ from length M, which is also a quarter wavelength, because the signal propagating media will be different.

One coupler 120 is used with each antenna element comprised of two patch dipoles to this embodiment. Thus, a total of eight couplers 120 is required for the antenna embodied in FIG. 6 below. A practical coupler 120 for use in the present invention embodiment, that is, for use at 1030–1090 MHz, would have a −3dB coupling between tracks 122 and 124 (points 122*d* and 124*e*). The line impedance of each of sections 122*b*, 122*c*, 124*b* and 124*c* is 50 ohms. The even-mode impedance of the overlying sections 122*a* and 124*a* is preferably 120.7 ohms, while the odd-mode impedance is preferably 20.7 ohms.

Refer now to FIG. 6 which shows antenna 10 in greater detail and to be comprised of ground plane conductor 11 and the eight antenna elements 12 through 19 mounted equally spaced on the phase center circle having diameter D. Mounted on the underside of ground plane conductor 11 are power splitters and phase shifters 90–97 which are each identical to the devices of FIG. 4. Of course, a different type of power splitter and phase shifter can be used, such as the device of FIG. 5.

The term "phase center" used herein is a term in the art which designates the apparent point from which a signal appears to emanate from an antenna element. In general no unique fixed point exists from which this occurs as the element is viewed from a variety of angles. However, to a reasonable degree of accuracy, a single point can often be found when viewing the element in the general direction of maximum radiation that will serve in a description of the array properties of such elements. By its very nature the "phase center" of an antenna element is difficult to compute from its physical configuration. The most useful estimate of the phase center is always determined by empirical methods. That is, an antenna element such as element 12 is fed as described above and the antenna field phase patterns sensed and plotted.

In the construction of the array, the antenna elements are mounted so that the previously determined phase centers fall on an imaginary "phase center circle". The antenna elements are equally spaced on the phase center circle, or in other words, arranged on equally spaced imaginary radial lines which emanate from the physical center 11*a* of the array so that the front and rear edges of the patch are perpendicular thereto. With the antenna elements so mounted on a 27 cm diameter circle the antenna patterns as the antenna is scanned through 360° of azimuth will be found to be relatively well behaved in the sense that the pattern will stay relatively constant as it is scanned. Of course, as with any practical real electronically scanned antenna array, there will be some variations in antenna pattern as the beam is scanned; however, these variations will generally be a minimum when the phase centers are placed as here taught. An antenna built according to the present invention for use at the range of frequencies from 1030 to 1090 MHz was constructed generally as shown in the present figures. The antenna elements of that antenna had the dimensions shown in FIG. 7 where antenna element 112 mounted on ground plane conductor 111 is comprised of patch dipoles 112*a* and 112*b* whose feedpoints 114 and 116, respectively, are spaced by one-quarter wavelength which, of course, is 7.06 cm at a center frequency of 1060 MHz. The width and length of each patch dipole is 6.10 and 4.95 cm respectively. The height of the dipole radiating plate above the ground plane conductor, that is, distance d of FIG. 2, is 0.64 cm for this antenna element. The antenna pattern extends in the direction of arrow 110, that is, the phase of the feed signal at point 114 lags the phase of the feed signal at point 116 by 90°. Each feedpoint is centered with respect to the width of its patch dipole and spaced 1.78 cm from the back edge, for example, edge 121 with respect to patch dipole 112*d*. The dipole shunt, for example foil 164, is at the back end of each patch dipole. The 0.89 and 1.02 cm lengths of side foil shorts shown represent typical values present in the full array. The fact that these are not identical is due to the different mutual couplings experienced by the inner and outer patches in the array.

Figure 7:
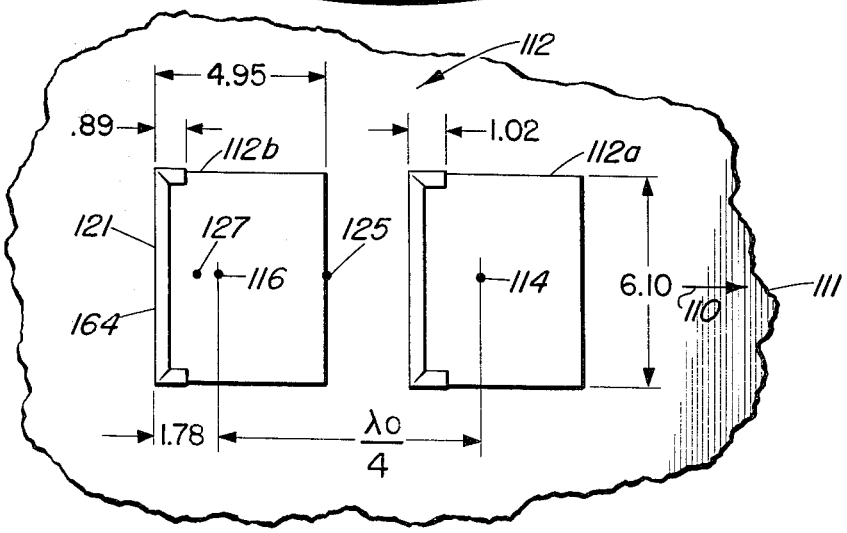

It should be understood that the location of the dipole shunt does not determine the direction in which the element will fire. The direction of element fire is determined by the phase difference of the signals fed to the various patch dipoles as fully explained above. In summary, the antenna element fires in the direction of signal lag so that, in the present case, where the signal fed to dipole 112*a* lags the signal fed to dipole 112*b* by 90° the antenna element fires in the direction of arrow 110. The location of the dipole shunt with respect to the direction of antenna element fire affects the location of the antenna element phase center. For example, when the antenna element of FIG. 7 is fired in the direction of arrow 110 the antenna element phase center for frontal azimuth radiation is found to be about at the forward edge of dipole 112*b* at position 125. However, when antenna element 112 is fired in the direction opposite to the direction of arrow 110 by interchanging the signal feeds to patch dipose 112*a* and 112*b* so that the signal fed to patch dipole 112*b* lags the signal fed to patch dipole 112*a* by 90°, the antenna element phase center measured over the pattern maximum in the rear is found to be close to feedpoint 116 at about position 127. This dependence of phase center position with direction of antenna element fire is believed not to be known by the prior art. By understanding this dependence one is able to construct antennas of the type here described which could not previously have been constructed. More specifically, and referring also to FIG. 6 again, an antenna designed for the frequency range 1030–1090 MHz, such as discussed above, was found to require a phase center circle diameter D of about 26.67 cm. With each antenna element oriented and arranged to fire in the direction of arrow 110 of FIG. 7, that is, with the dipole shunts toward the physical center of the array, it can be seen by resort to simple geometry that the required dipoles physically fit on the desired phase center diameter. However, if the antenna elements are fired in the direction opposite to the direction of arrow 110 of FIG. 7, that is, with the dipole shunts directed outward of the array, it can be seen that for the antenna element phase centers in this case to be positioned on the circle defined by the 26.67 cm phase center diameter all antenna elements must be shifted toward the center of the antenna array. Again by simple geometry it can be seen that the required patch dipoles do not fit this new arrangement. Narrower less efficient element might be made to fit, but mutual coupling between elements in the array would be greatly worsened by their close proximity to one another, degrading the patterns achieved by scanning.

Figure 8:
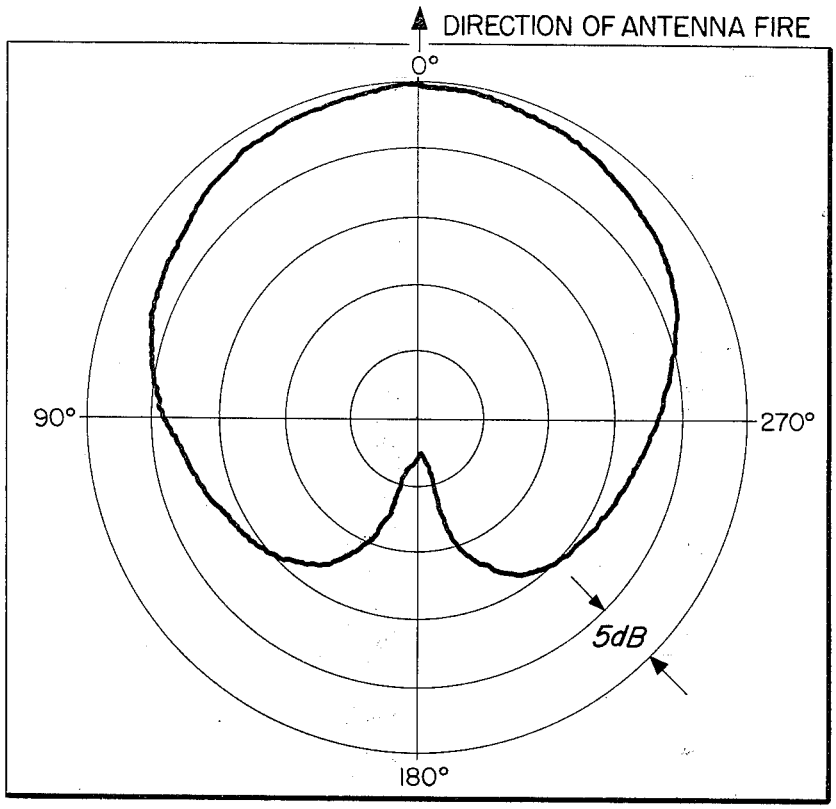
Figure 9:
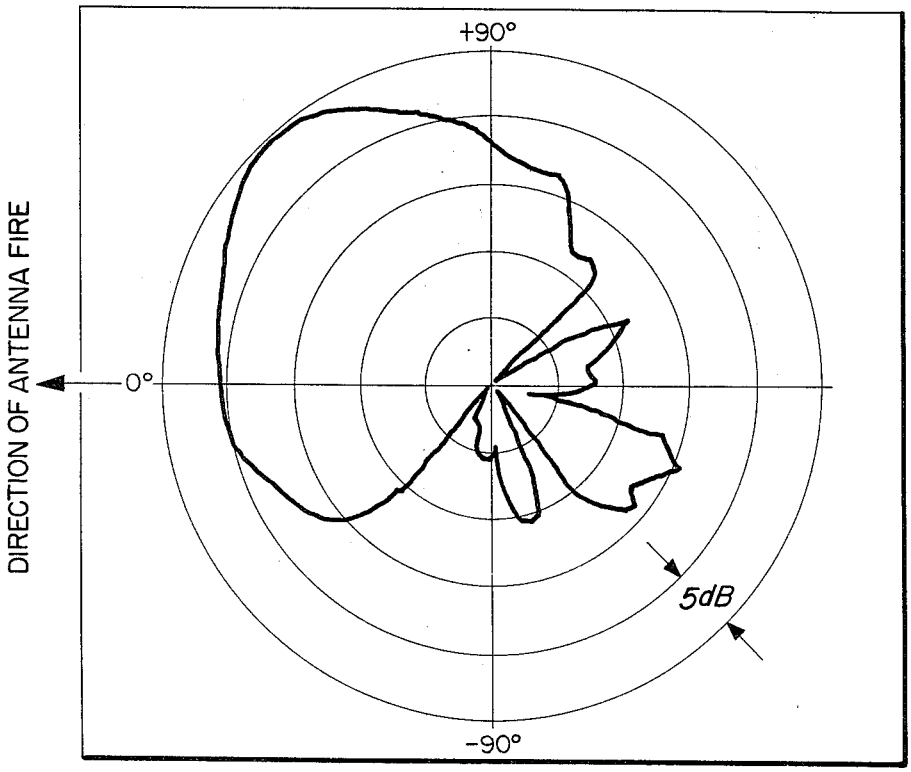

FIG. 8 shows the measured azimuth antenna pattern at zero degrees elevation for an antenna element arranged in an array like that of FIG. 6 on a nominal ground plane with the other seven antenna elements resistively terminated. Here the characteristic cardioid shaped sum pattern is apparent having directivity in the direction of antenna element fire, (0°). FIG. 9 shows the measured boresight principal plane elevation pattern for a single antenna element arranged in an antenna array with the other elements terminated.

Although the antenna patterns illustrated in FIGS. 8 and 9 are taken at 1060 MHz, the middle of the design frequency band, little gain degradation is experienced at the ends of the frequency band, 1030 and 1090 MHz because the dipoles are tuned by design to produce a constant mismatch of about 0.6 over the frequency band. This mismatch, of course, causes some power loss, which in the present case is about 2dB. This lost power is dissipated in the resistors of the power splitters, shown as resistor 104 in FIG. 4. One, having the benefit of the present teaching, can now design a narrow band tuning circuit using, for example, lossless matching elements, to tune the dipoles so as to avoid the above-mentioned 2dB loss. In the alternative, in the case where the antenna array is to be operated at only two distinct frequencies within a frequency band, a double tuned matching network tuned to the desired frequencies can be used to avoid the 2dB loss.

One skilled in the art ought now also be able to embody the invention other than as shown and taught above. For example, one could print an entire antenna array on a single copper clad dielectric sheet using, for example, plated through holes or screws as the dipole shunts. In that case the length L of each patch dipole will generally be shorter than shown in FIG. 7 since dielectric would be located in the fringing region off the open end of each patch. As another alternative an array can be constructed of bent sheet metal patches with no dielectric loading, except perhaps for an air-loaded, low dielectric constant foam, or small dielectric posts used for mechanical support. The lack of dielectric loading in this case, of course, requires that length L be more nearly a full quarter wavelength.

One having the benefit of the above teachings should now be able to find further modifications and alterations of my invention. Accordingly, the invention is to be limited only by the true spirit and scope of the appended claims.

The invention claimed is:

1. A low profile circular array antenna resonant at a design frequency comprising:

a ground plane conductor;

a plurality of N antenna elements, each comprised of at least two patch dipoles, each said dipole being comprised of a flat rectangular conductive plate arranged parallel to said ground plane conductor and spaced a predetermined distance which is less than a quarter wavelength of said design frequency above said ground plane conductor and electrically shunted along at least one edge of said plate to said ground plane, the dipoles comprising an antenna element being arranged on a radial line from a common center on said ground plane conductor, there being N equally spaced radial lines from said common center, one said line for each said antenna element, each said plate having a feedpoint, the feedpoints on the dipoles comprising an antenna element being separated along said line a predetermined distance equivalent to a phase shift of said design frequency;

a plurality of N isolated power splitter means, one for each antenna element, having at least first, second and third ports, the power at said first port being split to said second and third ports, and including means for electrically isolating said second and third ports and additionally including first means for connecting said second port to the feedpoint of one of said dipoles of the associated antenna element and second means for connecting said third port to the feedpoint of the other of said dipoles of the same associated antenna element, each said power splitter means including means for shifting the phase of a signal of said design frequency at the feedpoint of said one dipole with respect to the signal of said design frequency at the feedpoint of said other of said dipoles by a phase angle equivalent to said predetermined distance.

2. The low profile circular array antenna of claim 1 wherein said patch dipoles are shunted dipoles.

3. The low profile circular array antenna of claim 2 wherein a typical antenna element has a phase center, the phase centers of said N antenna elements being disposed on a circle concentric with said common center.

4. The low profile circular array antenna of claim 1 wherein said power splitter means comprises a substrate having a bifurcated stripline disposed thereon, each leg of said stripline terminating at one end at said first port, a first leg of said stripline terminating at the other end at said second port and the second leg of said stripline terminating at the other end at said third port, a resistor being connected between said second and third ports, said first and second legs being of equal length, said first and second means for connecting being first and second lengths of stripline connecting said second and third ports respectively to the feedpoints of said one and other of said dipoles, the difference in length of said second means for connecting with respect to said first means for connecting being equivalent to said predetermined distance between the feedpoints of said one and other of said dipoles.

5. The low profile circular array antenna of claim 4 wherein the impedance of each said leg of the phase splitter means is 70.7 ohms and the impedance of each said means for connecting is 50 ohms.

6. The low profile circular array antenna of claim 4 wherein each said phase splitter means leg is one quarter wavelength of said design frequency long.

7. The low profile circular array antenna of claim 1 wherein said predetermined distance is equivalent to a quarter wavelength of said design frequency.

8. The low profile circular array antenna of claims 1, 2 or 3 wherein the shunted edge of each dipole is arranged to be perpendicular to its associated line and toward the center of said array antenna, the phase splitter means being connected to said antenna elements to cause said antenna elements to end fire in a direction generally outward of said array antenna.

9. The low profile circular array antenna of claim 1 wherein said patch dipoles are microstrip patch dipoles.

10. The low profile circular array antenna of claim 1 wherein said power splitter means comprises a first transmission line space coupled to a second transmission line along the equivalent of about one-quarter wavelength of said design frequency, one end of said first transmission line comprising said first port and the other end of said first transmission line comprising said second port, one end of said second transmission line comprising said third port and the other end of said second transmission line comprised of a fourth port, said fourth port being terminated in a characteristic impedance.

11. The low profile circular array antenna of claim 10 wherein said first and second transmission lines comprise first and second microstrip transmission lines.

12. The low profile circular array antenna of claim 11 wherein said first and second microstrip transmission lines along said one-quarter wavelength at which they couple to one another have an even-mode impedance of about 120 ohms and an odd-mode impedance of about 20 ohms.

* * * * *